United States Patent [19]

Johnson et al.

[11] 4,043,491

[45] Aug. 23, 1977

[54] HOPPER BIN

[75] Inventors: Raymond A. Johnson, Grand Forks; John M. Lum; Mike Kazakoff, both of Christina Lake, all of Canada

[73] Assignee: Interior Mill Equipment Ltd., British Columbia, Canada

[21] Appl. No.: 720,736

[22] Filed: Sept. 7, 1976

[51] Int. Cl.[2] ..... B65D 47/00

[52] U.S. Cl. ..... 222/503; 214/16 R

[58] Field of Search ..... 222/502, 503, 512; 294/71, 70; 214/16 R, 17 R

[56] References Cited

U.S. PATENT DOCUMENTS

| | | | |
|---|---|---|---|
| 2,246,354 | 6/1941 | Garlinghouse | 222/503 |
| 3,145,057 | 8/1964 | Taggart | 222/502 |
| 3,319,807 | 5/1967 | Van Raden | 222/503 |
| 3,523,619 | 8/1970 | Jacobson | 214/16 R |

*Primary Examiner*—Robert B. Reeves
*Assistant Examiner*—Hadd Lane
*Attorney, Agent, or Firm*—Larson, Taylor and Hinds

[57] ABSTRACT

A bin for temporarily storing and subsequently dispensing particulate material has side and end walls with a discharge opening being defined between the lower edges of the walls. Material flow through the opening is controlled by a pair of gates normaly forming a bottom closure for the bin. The gates have spaced-apart inner side edges fitted with jaws in the form of longitudinally extending flanges. The flanges are spaced apart vertically and are staggered horizontally when the gates are closed and this arrangement serves to grip and hold a plug of material which seals the bottom opening to prevent loss of small amounts of the material.

4 Claims, 7 Drawing Figures

HOPPER BIN

This invention relates to hopper bins particularly intended for: use in the handling of particulate material such as wood chips.

Most saw mills ship their sawdust, as well as other waste material which has been reduced to chip form, to mills which use the divided material in the production of pulp, composition boards and so on. The material is discharged from the sawmill and must be temporarily stored before being loaded into vehicles for shipment. There are a number of hopper-type storage bins presently in use for this purpose but all known bins have a common disadvantage. It has been found difficult to stop the flow of a material such as wood chips as it is discharged from a bin. The gates of the bin must close against particles which vary in size, shape, moisture content and the like. Normally the particles are packed together by the meeting edges of the gates but, because of the previously mentioned characteristics of the material, the packing is not uniform enough along the considerable length of the discharge opening to provide a complete or end-to-end seal between the gate edges. As a result, some of the material continues to trickle out after the gates are fully closed and it is not uncommon to see the ground immediately below the bin littered with lost material which must be cleared away periodically.

The present invention offers a solution to this long-standing problem inherent in many chip-storing and dispensing bins by providing a gate arrangement which can readily be closed against the flow of the material and which will seize and retain a small portion of that material. This small portion forms a sealing plug extending from one end of the bin to the other, which plug effectively stops subsequent leakage of the material from the bin.

More specifically, a hopper bin according to the present invention comprises side and end walls having lower edges, said lower edges defining a discharge opening for the material, a pair of gates for controlling the flow of the material through the discharge opening, mounting means supporting the pair of gates for movement between open and closed positions, means for opening and closing the pair of gates, said pair of gates having inner side edges spaced on opposite sides of a vertical and longitudinally extending plane of symmetry of the bin when the gates are in the closed position and defining a gap therebetween, and a material-gripping jaw extending longitudinally of each inner side edge, said material-gripping jaws when the pair of gates are in the closed position partially bridging the gap whereby to hold therein a sealing plug of the particulate material.

Figure 1:
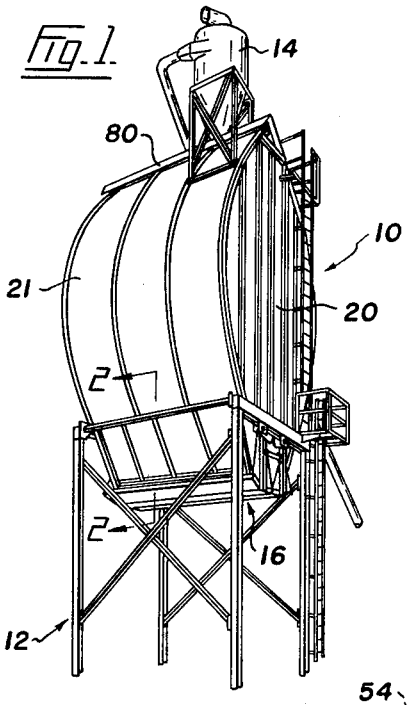
Figure 4:
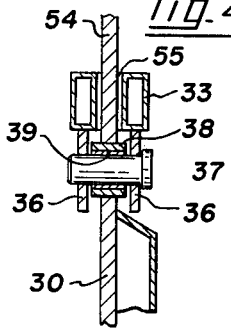
Figure 2:
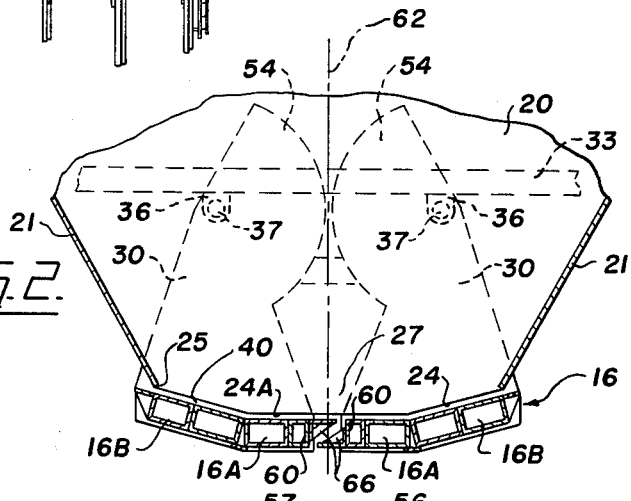
Figure 3:
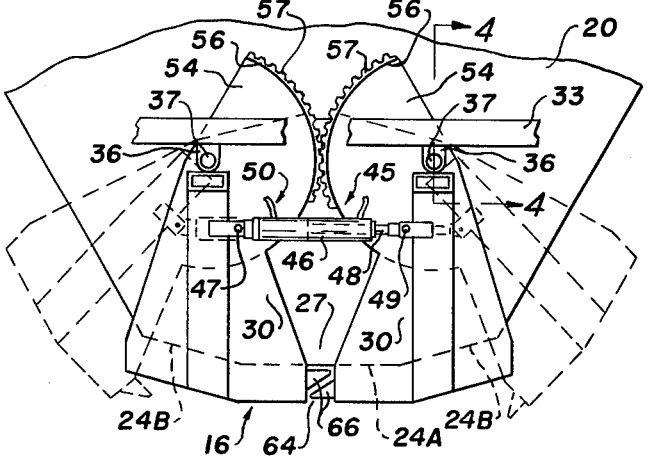
Figure 5:
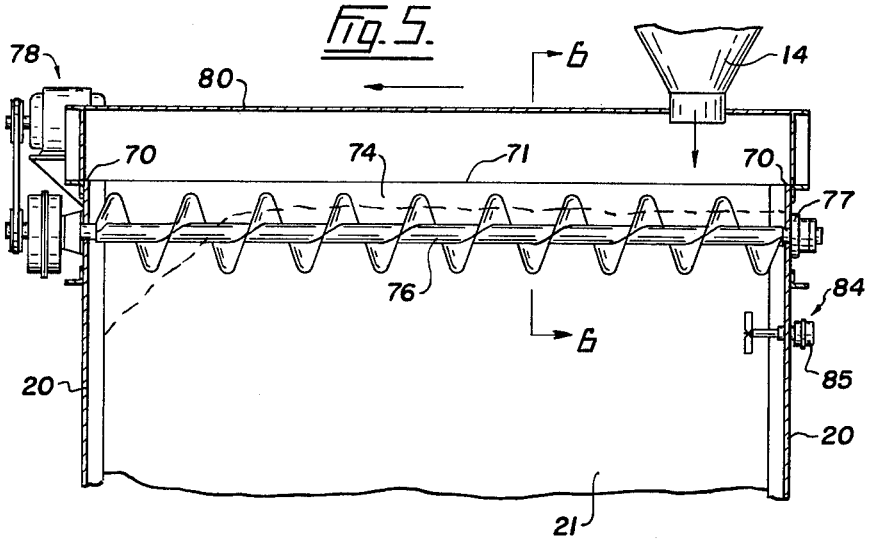
Figure 6:
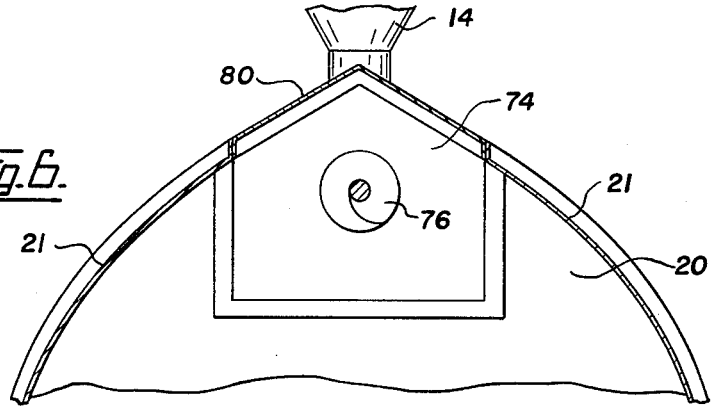
Figure 7:
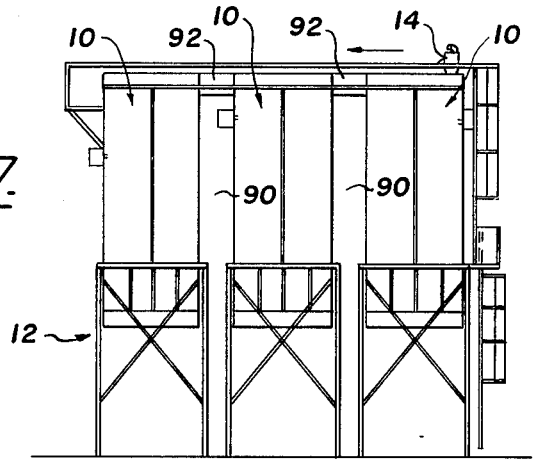

In drawings which illustrate a preferred embodiment of the invention,

FIG. 1 is a perspective view of a hopper bin in accordance with this invention, FIG. 2 is a detailed vertical section taken on the line 2—2 of FIG. 1 and showing the construction of a pair of gates for the bin, FIG. 3 is an end elevation of a lower part of the bin and the pair of gates, FIG. 4 is an enlarged vertical section taken on the line 4—4 of FIG. 3 and showing mounting means for each gate, FIG. 5 is a longitudinal section of the upper end of the bin, FIG. 6 is a vertical section taken on the line 6—6 of FIG. 5, and FIG. 7 is a small scale view showing three of the present bins joined together to provide a large-capacity installation.

Referring first to FIG. 1 of the drawings, the numeral 10 indicates generally a hopper bin for storing particulate material such as wood chips and the like. The bin is supported by a framework 12 through which trucks can be driven to pick up a load of chips. A conventional air conveyor system, which may include a cyclone 14 mounted on top of the bin, serves to fill the bin with chips and a pair of gates 16 at the bottom of the bin operate to control the flow of the chipped material into a waiting truck (not shown) parked within the framework 12.

The bin 10 has vertical end walls 20 and rounded side walls 21. Preferably, the walls 20 and 21 are inexpensively constructed of bolted metal panels. The inner surfaces of the four walls are smooth and unobstructed so that wood chips dropped into the top of the bin can settle freely to the bottom thereof. It will be noted that the side walls 21 curve outwardly and are symmetrical with respect to a vertical plane extending longitudinally through the bin. This curvature adds to the structural strength and capacity of the bin and further ensures that no hang-up of the material takes place within the bin as might otherwise occur particularly if the material was damp enough to become compacted.

In FIGS. 2 and 3, the walls 20 and 21 will be seen to have lower edges 24 and 25 respectively. Edges 24 of the end walls each have a central portion 24A which is horizontal and side portions 24B which are inclined upwardly at a slight angle to the horizontal. The edges 25 of the side walls are horizontal as well as being located in the same horizontal plane and these edges, with the edges 24, provide the bin 10 with an elongated and substantially rectangular discharge opening 27.

The pair of gates which are generally indicated by the numeral 16 are clamshell-like structures with are heavily constructed as will be seen in FIG. 2. The gates, of course, extend the full length of the bin and slightly beyond the end walls 20 where they are fitted with end plates 30. These plates 30 extend upwardly parallel to the end walls 20 of the bin and in close proximity to the outer surfaces of said end walls. At each end of the framework 12 there is a cross member 33 and the gates are carried by these frame members as shown best in FIGS. 2, 3 and 4. The members 33 are provided with depending pairs of brackets 36 with each pair carrying a pivot pin 37. The end plates 30 are each provided with a hub 38 in which a bearing 39 is mounted to journal one of the pins 37. In this manner, the pair of gates 16 are mounted for swinging movement about axes which are transversely spaced apart and which extend longitudinally of the bin. Thus, the pair of gates 16 are capable of swinging between a closed position which is shown by solid lines in FIGS. 2 and 3, to an open position as shown by dotted lines in FIG. 3 only.

The gates 16 are shaped to conform to the shape of the lower edges 24 of the bin end walls. In other words; each gate has a horizontal portion 16A and an upwardly inclined portion 16B, see particularly FIG. 2, which portions are spaced only a short distance from the corresponding portions of the lower edge 24. This arrangement allows the gate to swing freely between open and closed positions but provides a narrow slot 40 (FIG. 2) at each end of the bin when the gates are shut. The end plates 30 on the shut gates serve as closures for the slots 40 except for a narrow gap where the plates do not meet at the very center of the bin.

Power means generally indicated at 45 (see particularly FIG. 3) are provided to open and close the gates 16. It will be noted there is one such power means at each end of the bin. Each power means 45 comprises a hydraulic cylinder 46 which is pivotally mounted as at 47 on one of the gates. Piston rod 48 of this cylinder is pivotally connected as at 49 to the other gate. The cylinders 46 form part of a suitable hydraulic circuit, indicated by the numeral 50 in FIG. 3 only, which allows the driver of a truck being filled with chips, or an operator of the storage bin, to open and close the gates from a position on the ground alongside the framework 12.

To ensure that the pair of gates 16 open and close in unison, the end plates 30 are provided with quadrants 54 which are shown in detail in FIGS. 2 and 3. These quadrants each extend upwardly through a slot 55 (FIG. 4 only) formed in the adjacent cross member 33 of the framework. The quadrants 54 have opposing edges 56 which are radiused about the pivot pins 37 and fitted to the edges are toothed racks 57 which intermesh to provide the desired unitary operation of the gates.

Referring again to FIG. 2, the gates 16 will be seen to have inner side edges 60 which are spaced apart when the gates are closed. The opposing edges 60 of the closed gates are equidistantly spaced on either side of a vertical plane represented by chain dotted line 62 in FIG. 2 which is considered as the plane of symmetry of the bin. This spacing provides a gap 64 which extends the full length of the bin and normally material would be able to flow through this gap were it not for the presence of material-gripping jaws 66.

The jaws 66 are secured one to each inner side edge 60 to extend the full length of the gate. One jaw forms an extension of the upper surface of a gate portion 16A while the other jaw is coplanar with the underside of the adjacent gate portion 16A. Put another way, the jaws 16 are vertically staggered when the gates are closed and the free edges of the jaws overlap or project equal distances beyond opposite sides of the plane 62.

The closed gates support the weight of a load of wood chips contained within the bin but the power required to swing the gates open against the pressure exerted by the load is not great with the parts arranged and operated as described. Closing the gates against the downward flow of material discharging through the opening 27 presents no problem until a point is reached when the gates are approaching the fully shut position. At this time, a small amount of the material is trapped between the opposing edges of the gates. Hitherto, this entrapment was not uniform or continuous throughout the length of the gates so that some materials continued to trickle through openings in the trapped material and this was undesirable. The present arrangement of the jaws 66 solves this problem by capturing a positively-supported sealing plug of the material between the vertically spaced and horizontally staggered jaws. This sealing plug of the particulate material is continuous along the length of the gate and is firmly held by the jaws against collapse in places throughout its length which action would provide openings through which some of the material could trickle and perhaps be lost. Thus, a proper seal is formed between the spaced-apart inner side edges 60 of the gates.

The end walls 20 and side walls 21 of the bin have upper edges 70 and 71 respectively which define an infeed opening 74, see FIG. 5. A screw conveyor 76 is journalled as at 77 on the end walls of the bin and this conveyor extends lengthwise of the infeed opening 74. The conveyor is adapted to be driven by means generally indicated at 78. A suitable cover 80 is secured to the upper edges 70 and 71 to extend over the infeed opening 74. The cyclone 14 projects through the cover 80 to discharge into the top opening near one end wall of the bin and the conveyor is operated to move material towards the opposite end wall. The material is shifted in this manner only when the bin immediately below the cyclone fills to a predetermined level. The operation of the screw conveyor 76 is controlled by a conventional level indicator 84 (FIG. 5) which is mounted on an end wall of the bin near the top opening. Indicator 84 is connected by a suitable electric circuit (not shown) to an electric motor 85 of the drive mean 78 and to a source of power whereby the motor is energized to operate the conveyor only when the material reaches the predetermined level.

The bin 10 may be used by itself or may be arranged in series with a number of other similar bins. For example, in FIG. 7, three such bins are shown arranged in series to provide a large capacity installation. The cyclone discharges into one of the end bins as before and the conveyor is operated to shift the material towards the far end of the bin as previously described. The bins are spaced a short distance apart to leave gaps 90 between and these gaps are bridged by a short length of trough 92. When two or more bins are used, the screw conveyor is lengthened to transfer the material from the first bin to the second bin and thence to the third bin. The second and third bins are provided with their own level indicators 84 which are suitably spaced with respect to the first indicator. This arrangement ensures that a proper level of material is maintained within each of the three bins.

From the foregoing, it will be apparent we have provided a hopper bin which is particularly well adapted for use in storing and loading wood chips and the like. The covered screw conveyor 76, for example, is especially suited for transferring material such as hog fuel, sawdust, wood chips and shavings all of which have a tendency to form lumps or otherwise become compacted particularly when wet. The present conveyor arrangement in the top of the hopper bin will break down lumps whereas a conventional flight or belt conveyor will not. The gates 16 can handle the same materials and are easy to open and close as well as providing complete control over discharge from the bin. There is very little if any spillage from the bottom of the present bin and the bin operator can accurately control the size of the truck load from a safe and uncluttered position where he has the required view of the truck body.

We claim:

1. A hopper bin for particulate material comprising side and end walls having lower edges defining a discharge opening for the material, a pair of gates for controlling the flow of material through the discharge opening, mounting means supporting the pair of gates for movement between open and closed positions, power means for opening and closing the pair of gates, said pair of gates having inner side edges spaced apart to define a gap extending longitudinally when the pair of gates are closed, a material-gripping jaw secured to each inner side edge to extend longitudinally thereof, said jaws being vertically spaced apart and having free edges which overlap horizontally when the pair of gates are closed, said side and end walls having upper edges defining an infeed opening for the material, a screw conveyor mounted between the upper edges to extend longitudinally of the infeed opening, and drive means for rotating the screw conveyor to move material towards an end wall of the bin.

2. A hopper bin as claimed in claim 1, in which said side walls curve outwardly between the lower and upper edges thereof.

3. A hopper bin for particulate material comprising side and end walls having lower edges, said lower edges defining a discharge opening for the material, a pair of gates for controlling the flow of material through the discharge opening, mounting means supporting the pair of gates for movement between open and closed positions, means for opening and closing the pair of gates, said pair of gates having inner side edges spaced on opposite sides of a vertical and longitudinally extending plane of symmetry of the bin when the gates are in the closed position and defining a gap therebetween, and a material-gripping jaw extending longitudinally of each inner side edge, said material-gripping jaws when the pair of gates are in the closed position partially bridging the gap whereby to hold therein a sealing plug of the particulate material, said jaws being vertically spaced apart and having free edges which overlap horizontally when the pair of gates are in the closed position.

4. A hopper bin as claimed in claim 3, in which said lower edges of the side walls have horizontal central portions and upwardly inclined side portions, said pair of gates each having portions corresponding to the central and side portions whereby to define end slots therewith when said pair of gates are in the closed position, said pair of gates each having an end plate on opposite ends thereof, said end plates extending alongside the end walls of the bin to provide closures for the end slots, said means for opening and closing the pair of gates comprising a hydraulic cylinder and a piston rod therefor near each end wall, pivot means operatively connecting the cylinders and their piston rods to the pair of gates, and gear means interconnecting adjoining end plates whereby the pair of gates move in unison between open and closed positions.

* * * * *